United States Patent [19]

Sudbeck et al.

[11] Patent Number: 4,531,899

[45] Date of Patent: Jul. 30, 1985

[54] POSITIVE DISPLACEMENT ROTARY GAS COMPRESSOR PUMP

[75] Inventors: Rainer Sudbeck, Wassenberg; Hans Baumgartner, Viersen; Manfred Brandstadter, Dusseldorf, all of Fed. Rep. of Germany

[73] Assignee: Pierburg GmbH & Co KG, Neuss, Fed. Rep. of Germany

[21] Appl. No.: 526,153

[22] Filed: Aug. 24, 1983

[30] Foreign Application Priority Data

Aug. 26, 1982 [DE] Fed. Rep. of Germany ..... 3231754

[51] Int. Cl.[3] ..... F04C 17/02

[52] U.S. Cl. ..... 418/59; 418/6

[58] Field of Search ..... 418/59, 6

[56] References Cited

U.S. PATENT DOCUMENTS

| | | | |
|---|---|---|---|
| Re. 24,500 | 7/1958 | Stratveit | 418/59 |
| 146,741 | 1/1874 | Allyn | 418/59 |
| 493,844 | 3/1893 | Schröder | 418/59 |
| 550,328 | 11/1895 | Pukerud | 418/6 |
| 1,974,225 | 9/1934 | Varley | 418/59 |
| 2,538,598 | 1/1951 | Stratveit | 418/59 |
| 2,649,053 | 8/1953 | Stratveit | 418/59 |
| 2,684,036 | 7/1954 | Stratveit | 418/59 |
| 3,473,728 | 10/1969 | Vulliez | 418/59 |

FOREIGN PATENT DOCUMENTS

| | | | |
|---|---|---|---|
| 532971 | 8/1931 | Fed. Rep. of Germany . | |
| 1064076 | 8/1959 | Fed. Rep. of Germany . | |
| 1330162 | 5/1963 | France | 418/59 |
| 498749 | 9/1954 | Italy | 418/59 |
| 57-8385 | 1/1982 | Japan | 418/59 |
| 133040 | 9/1951 | Sweden | 418/59 |

*Primary Examiner*—William R. Cline
*Assistant Examiner*—John J. McGlew, Jr.
*Attorney, Agent, or Firm*—Roberts, Spiecens & Cohen

[57] ABSTRACT

A positive displacement rotary gas compressor pump comprising a ring piston having an annular wall with a gap forming confronting inlet and outlet ends, the outlet end, during the compression of the gas in the inner and/or outer pumping chambers, cooperating with a bridging wall portion joining two concentric cylinder walls, or with the end of the inner cylinder wall near its transfer port, so that the gas is compressed before being discharged from the pump.

2 Claims, 5 Drawing Figures

POSITIVE DISPLACEMENT ROTARY GAS COMPRESSOR PUMP

FIELD OF THE INVENTION

The invention relates to a positive displacement rotary gas compressor pump having a ring piston orbiting in an annular chamber formed by concentric cylinder walls of the housing and by a bridging wall portion which joins the cylinder walls together, the ring piston being driven by an eccentric crankshaft stub along a circular path and controlled to move on an open path by a crank arm which is pivoted to the housing and to the ring piston. The distance between the pivots of the crank arm is greater than the throw of the crankshaft, so that the ring piston produces a pumping action. The ring piston has a longitudinal opening for accommodating the bridging wall portion, the opening separating, as seen in cross section, an inlet end of the ring wall of the piston from an outlet end thereof.

PRIOR ART

Pumps of this general type convey the fluid in a unidirectional stream and the piston surface travels comparatively slowly relative to the cylinder surface. Consequently, these pumps are particularly suitable for use as gas compressors and vacuum pumps, where it is desired to achieve a high compression ratio with little need for lubrication, or without any lubrication at all.

However, the manufacture of pumps of this type requires precision dimensioning of the radial clearance gaps between the surface of the ring piston and the surface of the cylinder wall, particularly if the pump is designed to operate without actual contact between these two surfaces, i.e. if a small residual gap remains between them. If the gap is too large this can give rise to serious pressure losses.

German Pat. No. 17 76 54 discloses a pump of this general type which has, as shown in FIGS. 3 and 4 of this patent, a symmetrical ring piston, i.e. a ring piston with a transverse central plate from which the ring wall projects axially outwards symmetrically on both sides of the central plate, which itself supports the hub for the crankshaft drive. The ring piston has a longitudinal slot slidably receiving the longitudinal baffle wall, and baffle wall extending radially between the concentric cylinder walls.

The inner cylinder walls are, of necessity, axially slotted to receive the transverse central plate. However, the baffle wall, which extends between the concentric cylinder walls, joining them together, must remain uninterrupted, otherwise the compression chambers would be short-circuited to the suction chambers. The baffle wall must therefore penetrate edgewise into the central plate, which has to have an aperture for this purpose, i.e. to accommodate the baffle wall during the orbiting of the ring piston. This aperture is not shown in the drawing, in this patent, but it is mentioned in the text.

The aperture must be wider than the baffle wall, which swings sideways relative to the ring piston during the orbiting movement. This opens a passage through which gas from the compression pumping chamber escapes across to the suction pumping chamber, causing serious pressure loss and resulting in low pump efficiency.

SUMMARY OF THE INVENTION

An object of the present invention is to provide a pump of the type mentioned hereinabove but in which the compression and suction chambers are not short-circuited to each other and in which, in order to compensate pressure losses and to improve pumping efficiency, the medium is internally compressed before being discharged from the pump. This is possible if the medium in a gas. The pump of the present invention is therefore suitable for use as a gas compressor.

The object is achieved, according to the invention, in that the bridging wall portion partly follows, although still leaving a minimal gap, the envelope surface described by the outlet end of the piston ring wall in its compression movement from the outer cylinder wall towards the inner cylinder wall, or in that the outlet end of the ring wall has an inwardly projecting extension, the transfer end, as seen in cross section, of the inner cylinder wall partly following, although still leaving a minimal gap, the envelope surface described by the extension in its compression movement from the inner cylinder wall towards the outer cylinder wall.

The construction according to the present invention has the following advantages:

(a) The pump provides internal compression, which not only improves pumping efficiency but also reduces the overall dimensions of the pump. Furthermore, by modifying the outlets from the compression chambers, internal compression can be provided in both the pumping chambers, or in only one of them, or in neither of them.

(b) The bridging wall portion is interrupted, either by a radial extension tongue or by a circular end plate of the pivoted cranked arm, the circular end plate being in a complementary recess in the extension tongue, in such a way that short-circuiting of the compression chamber to the suction chamber, as occurs in the prior art pumps, is avoided.

(c) The symmetrical construction of the ring piston and the fact that it rotates freely on the eccentric stub shaft of the crankshaft allows the pump to be operated at high rotational speeds, which makes it easy to assemble the pump and gives it a high pumping efficiency.

BRIEF DESCRIPTION OF THE FIGURES OF THE DRAWING

The invention will be described with reference to the drawing, in which.

DETAILED DESCRIPTION

Figure 1:
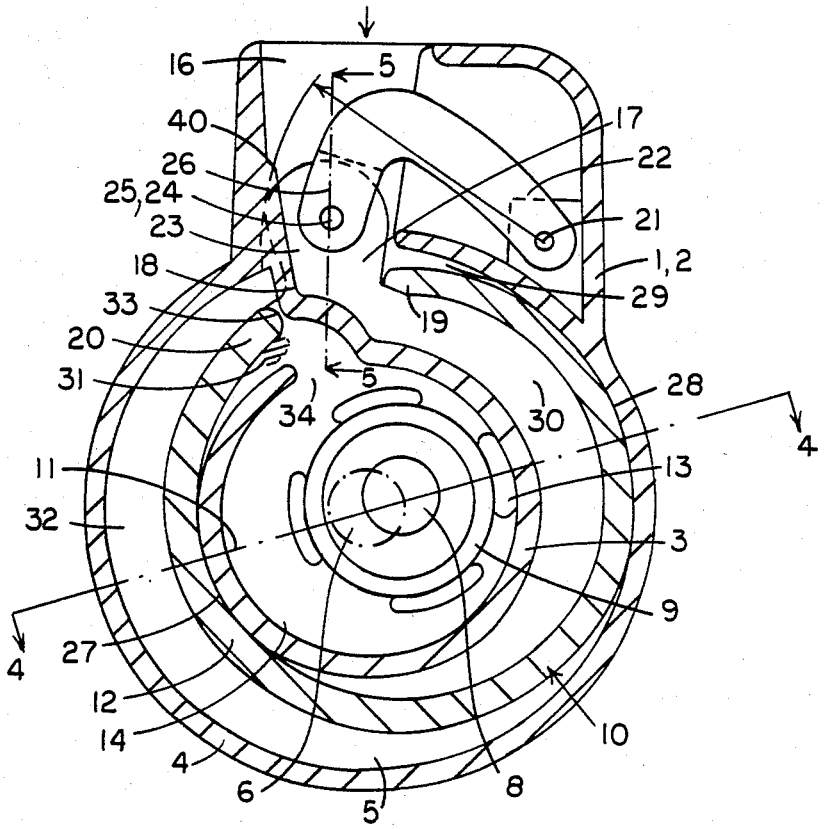
FIG. 1 is a transverse cross section through the gas compressor pump of the invention, with internal compression in one of the pumping chambers.
Figure 4:
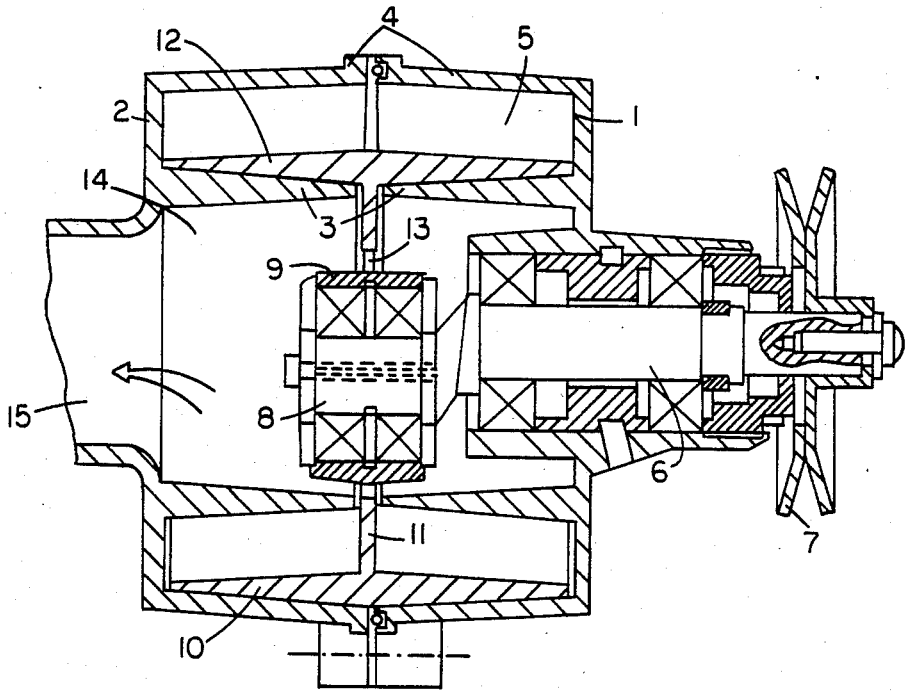
FIG. 4 is a longitudinal section through the pump along line 4—4 in FIG. 1, the plane of the section passing through both near contact locations of the ring piston and cylinder walls.
Figure 5:
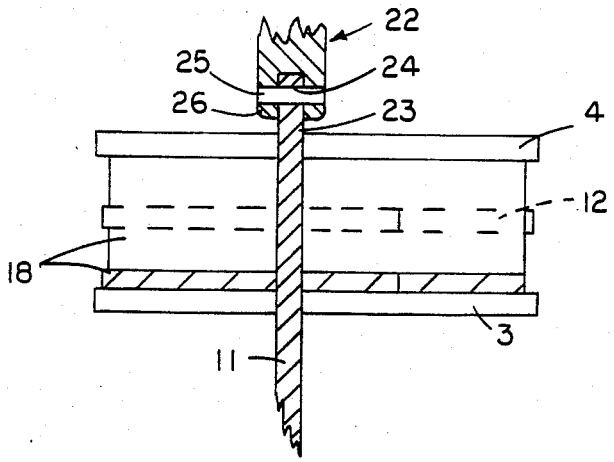
FIG. 5 is a section taken along line 5—5 in FIG. 1.

Referring first to FIGS. 1 and 4, therein is seen a compressor housing having two halves 1 and 2 which, when assembled together, form two concentric cylinder walls 3 and 4 enclosing between them an annular chamber 5. The housing half 1 supports a bearing in which rotates a crankshaft 6 terminating externally in a pulley 7 adapted to receive a drive belt.

At its other end, the crankshaft 6 terminates in an eccenctric crankshaft stub 8. Stub 8 rotates in a hub 9 of a ring piston 10, so that the ring piston 10 is driven in orbital movement in the interior of the annular chamber 5. The ring piston 10 comprises a transverse central plate 11 supporting an annular or ring wall 12. The central plate 11 has transfer ports 13 through which gas can flow into an outlet chamber 14 formed by the cylinder wall 3 and thus be discharged from the compressor through an outlet port 15 leading to a utilization device (not shown). It will be observed that when the ring piston 10 is orbiting, the transfer ports 13 in the central plate 11 never move radially outwards beyond the outlet chamber 14.

The outlet port 15 extends axially outwards from the outlet chamber 14. The compressor housing also has a gas inlet port 16 extending radially inwards into the annular chamber 5. The gas inlet port 16 is formed by the two housing halves 1, 2, when they are assembled together. The ring piston 10 has a longitudinal opening 17 through which passes a longitudinal bridging wall portion 18 which connects the two concentric cylinder walls 3, 4 together, as shown clearly in FIGS. 1, 2 and 3. As seen in cross section in FIGS. 1, 2 and 3, the two edges of the longitudinal opening 17 form inlet end 19 and outlet end 20 of the ring wall 12 of the ring piston 10. The transverse central plate 11 of the ring piston 10 has an extension tongue 23 which extends radially outwards through the longitudinal opening 17 into the gas inlet port 16. Housed in the gas inlet port 16 is a crank arm 22 which is pivoted, at one end, by a pivot pin 27 to the pump housing. The other end of the crank arm 22 is pivoted to the transverse central plate 11 by a second pivot pin 25 which is anchored in a forked end 26 of the crank arm 22 and rotates in a bore 24 in the extension tongue 23. The crank arm 22 controls the movement of the ring piston 10 such that at pin 25 the ring piston undergoes reciprocal movement along an arcuate open path centered at pin 21. A composite orbital movement of the ring piston 10 is produced due to the circular input motion from stub 8 and the arcuate control path provided by the crank arm 22. To obtain the orbital movement of the ring piston along an open path at pin 25, the distance between pins 21 and 25 is greater than the eccentricity of stub 8, i.e. the radius of the input drive imparted to the ring piston by the crankshaft.

When the compressor is in operation, the ring piston 10, orbiting within the annular chamber 5, always makes near contact at one location 28 with the outer cylinder wall 4 of the pump housing, and at another location 27 with the inner cylinder wall 3. Stated otherwise, the ring piston very nearly, but not quite, makes contact at these locations, so that a small gap remains. In this orbiting movement, the ring piston 10 forms a total of four pumping chambers 29, 30, 31, 32, two of which (chambers 29, 30) act as suction chambers, the other two (chambers 31, 32) as compression chambers. The suction chambers 29 and 30 aspirate atmospheric air, or gas from a gas source, through the longitudinal opening 17. The two compression chambers 31 and 32 discharge compressed medium (air or gas) through a gap 33 which is formed between the outlet end 20 of the ring wall 12 and the bridging wall portion 18, and through a transfer port 34 in the cylinder wall 3, into the outlet chamber 14, from where the medium is discharged from the pump through the outlet port 15.

A point to observe is that in the embodiment of FIG. 1 the medium (air or gas) is conveyed by the two inner pumping chambers 30 and 31 without internal compression, whereas the two outer pumping chambers 29 and 32 provide internal compression, this being produced in that the outlet end 20 of the ring wall 12, moving from the outer cylinder wall 4 towards the inner cylinder wall 3, at first moves close to the surface of the bridging wall portion 18, compressing the medium, and only a little later, during a second phase of this movement, comes clear of the bridging wall portion 18, allowing the medium to escape through the gap 33 which has now opened up between the outlet end 20 of the ring wall 12 and the bridging wall portion 18. In conventional pumps, the medium escapes during the first phase of this movement and, consequently, no internal compression is obtained.

Figure 2:
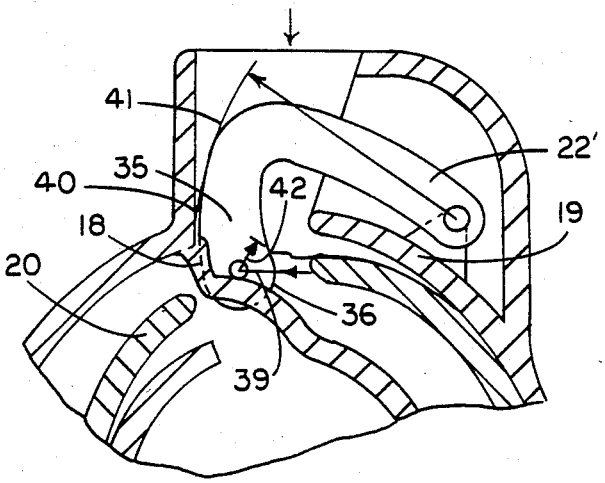
FIG. 2 shows a portion of another embodiment.

In the embodiment of FIG. 2, the crank arm 22' terminates at its inner end in a circular end plate 35 which rotates in a complementary circular recess 36 in the transverse central plate 11 of the ring piston 10 at a location between its inlet end 10 and its outlet end 20. The end plate 25 has the same thickness as the transverse central plate 11.

Figure 3:
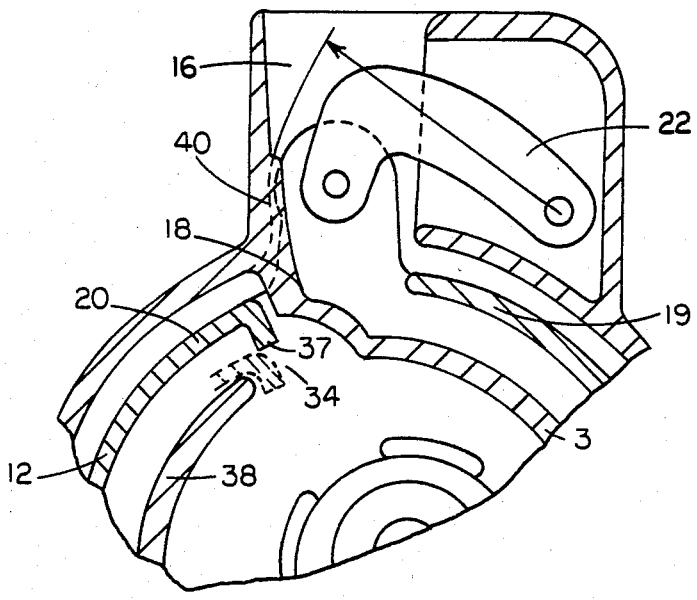
FIG. 3 shows a pump with internal compression in both the pumping chambers.

In the embodiment of FIG. 3 all four pumping chambers 29, 30, 31 and 32 provide internal compression. The outlet end 30 of the ring wall 12 has an inwardly projecting extension 37. During the compressing movement from the inner cylinder wall 3 towards the outer cylinder wall 4 it is only in a second phase of this movement that a gap opens up between the extension 37 and the end 38 of the inner cylinder wall 3 near the transfer port 34, with the consequence that internal compression is obtained. In the conventional pumps, the medium escapes during the first phase of this movement and, consequently, no internal compression is obtained.

In all embodiments of the invention, minimal gaps are obtained between the compression and the suction chambers of the pump by the use of confronting part-cylindrical surfaces such as surface 39 on the end plate 35 of crank arm 22' which rides in the cylindrical surface of recess 36, and surface 40 on the housing which faces a corresponding surface of the tongue 23 in FIG. 1 or the outer surface 41 of crank arm 22' in FIG. 2.

From the above it is seen that the invention provides a positive displacement rotary gas compressor pump in which the ring piston 10 undergoes a composite orbital movement due to the rotational drive imparted by the eccentric crankshaft stub 8 and by the reciprocal travel at pin 25 along an open path produced by the crank arm 22. The orbital movement is obtained by virtue of the construction wherein the distance between the pivotal connections 21 and 25 of the crank arm is greater than the eccentricity of the crankshaft stub relative to the crankshaft 6 and this produces the pumping action on the medium in the chambers. In order to achieve compression of the medium internally in the chambers, the bridging wall portion 18 is shaped in the region facing the outlet end 20 of the ring wall 12 to conform to the envelope surface described by the outlet end in moving between the inner and outer cylinder walls during the compression movement while still leaving a minimal gap therebetween.

In the embodiment shown, the ring wall moves from the outer housing wall towards the inner housing wall and the outlet end 20 approaches the bridging wall portion in the course of this movement and thereafter moves away from the bridging wall portion. As a consequence, the medium undergoes compression during the first phase of the compression movement to develop internal compression of the medium in the pump. Thereby, the medium is compressed before being discharged from the pump.

Although the invention has been described in relation to specific embodiments thereof, it will become apparent to those skilled in the art that numerous modifications and variations can be made without departing from the scope and spirit of the invention, as defined in the attached claims.

What is claimed is:

1. A positive displacement rotary compressor pump for a compressible gas comprising a housing including concentric inner and outer cylinder walls defining an annular chamber therebetween, and a radial bridging wall portion joining said walls together, a ring piston in said chamber defining suction and compression chambers with said walls, an eccentric crankshaft stub drivingly connected to said ring piston to impart rotational drive to said ring piston, a crank arm pivotably connected to said housing and to said ring piston to control the movement of the ring piston to be along a reciprocal open path at the connection with the crank arm, the distance between the pivotal connections of said crank arm being greater than the eccentricity of the crankshaft stub so that the ring piston produces a pumping action on the compressible gas in the chambers, said ring piston including a ring wall having a longitudinal opening accommodating said bridging wall portion, said ring wall having spaced ends at said longitudinal opening constituting inlet and outlet ends, said outlet end being at the outlet of a compression chamber and undergoing displacement between said outer cylinder wall and said inner cylinder wall during compression of gas in the latter said compression chamber, said bridging wall portion being shaped to conform in part to the envelope surface described by said outlet end of the ring wall in the movement of said ring wall between the outer cylinder wall and the inner cylinder wall during compression such that said wall portion is proximate said oulet end leaving a minimal gap therewith during a first portion of the movement of said ring wall causing compression of said gas in said chamber prior to discharge of the gas from said chamber whereafter said outlet end moves away from said wall portion so that the compressed gas can be discharged under pressure from said compression chamber, a radially inwards projecting extension on said outlet end of the ring wall of said piston, said inner wall of said housing having a transfer end defining a transfer port with said bridging wall portion for discharge of compressed medium from the pump, said extension coming into proximity with said transfer end to form a minimal gap therewith during compression of the medium.

2. A positive displacement rotary compressor pump for a compressible gas comprising a housing including concentric inner and outer cylinder walls defining an annular chamber therebetween, and a radial bridging wall portion joining said walls together, a ring piston in said chamber defining suction and compression chambers with said walls, an eccentric crankshaft stub drivingly connected to said ring piston to impart rotational drive to said ring piston, a crank arm pivotably connected to said housing and to said ring piston to control the movement of the ring piston to be along a reciprocal open path at the connection with the crank arm, the distance between the pivotal connections of said crank arm being greater than the eccentricity of the crankshaft stub so that the ring piston produces a pumping action on the compressible gas in the chambers, said ring piston including a ring wall having a longitudinal opening accommodating said bridging wall portion, said ring wall having spaced ends at said longitudinal opening constituting inlet and outlet ends, said outlet end being at the outlet of a compression chamber and undergoing displacement between said outer cylinder wall and said inner cylinder wall during compression of gas in the latter said compression chamber, said bridging wall portion being shaped to conform in part to the envelope surface described by said outlet end of the ring wall in the movement of said ring wall between the outer cylinder wall and the inner cylinder wall during compression such that said wall portion is proximate said outlet, said ring piston and said inner and outer walls forming two of said compression chambers, said outlet end of said ring wall including means thereon for providing compression of said gas in each of said compression chambers before discharge of the compressed gas from the respective compression chamber, said means on said outlet end of said ring wall comprising a projection thereon which cooperates with said shaped bridging wall portion and with said inner cylinder wall, said inner wall having an end spaced from said bridging wall portion to define a transfer port for discharge of compressed gas from said pump, said projection on said ring wall confronting said end of said inner wall with minimal clearance during compression of gas in one of said chambers.

* * * * *